US008044581B2

(12) United States Patent
Park et al.

(10) Patent No.: US 8,044,581 B2
(45) Date of Patent: Oct. 25, 2011

(54) INORGANIC ELECTROLUMINESCENCE DEVICE

(75) Inventors: Shang-hyeun Park, Yongin-si (KR); Se-gi Yu, Yongin-si (KR); Jin-Young Kim, Suwon-si (KR); Min-jong Bae, Yongin-si (KR); Tae-won Jeong, Yongin-si (KR)

(73) Assignees: Samsung Electronics Co., Ltd. (KR); Hankuk University of Foreign Studies Research and Industry-University Cooperation Foundation (KR)

( * ) Notice: Subject to any disclaimer, the term of this patent is extended or adjusted under 35 U.S.C. 154(b) by 184 days.

(21) Appl. No.: 12/581,357

(22) Filed: Oct. 19, 2009

(65) Prior Publication Data

US 2010/0270918 A1 Oct. 28, 2010

(30) Foreign Application Priority Data

Apr. 23, 2009 (KR) ..... 10-2009-0035528

(51) Int. Cl.
*H01J 1/62* (2006.01)

(52) U.S. Cl. ..... 313/506; 313/507

(58) Field of Classification Search ..... 313/498, 313/506, 507, 509, 512
See application file for complete search history.

(56) References Cited

U.S. PATENT DOCUMENTS

| | | | | |
|---|---|---|---|---|
| 7,834,545 | B2 * | 11/2010 | Zhang et al. | 313/506 |
| 2007/0210704 | A1 * | 9/2007 | Park et al. | 313/506 |
| 2007/0295714 | A1 | 12/2007 | Liu et al. | |
| 2008/0007157 | A1 | 1/2008 | Carroll et al. | |
| 2008/0171193 | A1 | 7/2008 | Yi et al. | |

FOREIGN PATENT DOCUMENTS

| | | | |
|---|---|---|---|
| JP | 2006-127780 | A | 5/2006 |
| KR | 1020020091640 | A | 12/2002 |
| KR | 1020070092588 | A | 9/2007 |

* cited by examiner

*Primary Examiner* — Vip Patel
(74) *Attorney, Agent, or Firm* — Cantor Colburn LLP

(57) ABSTRACT

An inorganic field emission device includes a first electrode, a second electrode spaced apart from the first electrode, and a light emitting layer disposed therebetween. A dielectric layer is disposed between the first electrode and the light emitting layer and/or between the second electrode and the light emitting layer. A field reinforcing layer is disposed between a dielectric layer and the light emitting layer and includes carbon nanotubes having a length of about 20 nanometers to about 1 micrometer.

20 Claims, 4 Drawing Sheets

INORGANIC ELECTROLUMINESCENCE DEVICE

CROSS-REFERENCE TO RELATED APPLICATION

This application claims priority to Korean Patent Application No. 10-2009-0035528, filed on Apr. 23, 2009, and all the benefits accruing therefrom under 35 U.S.C. §119, the content of which in its entirety is herein incorporated by reference.

BACKGROUND

1) Field

The general inventive concept relates to an inorganic field emission device, and more particularly, to a dispersion-type inorganic field emission device.

2) Description of the Related Art

Inorganic field emission devices have simple manufacturing processes and therefore can be manufactured at lower cost relative to other types of displays. As a result, inorganic field emission devices are often used for large screen displays. In addition, inorganic field emission devices have been used in display fields or light source fields. However, research has been conducted for using inorganic field emission devices in various other fields.

An inorganic field emission device is classified as either a thin film-type inorganic field emission device or as a dispersion-type inorganic field emission device. More particularly, the thin film-type inorganic field emission device has a structure in which a light emitting layer that includes phosphor is disposed between two organic dielectric layers. In contrast, a dispersion-type inorganic field emission device includes a light emitting layer in which phosphor particles are dispersed in an insulating binder. The dispersion-type inorganic field emission device, however, has a lower brightness compared to that of other displays, such as a liquid crystal display ("LCD"), a plasma display panel ("PDP") or organic electroluminescence devices. As a result, there is a need to develop a dispersion-type inorganic field emission device having a substantially improved brightness.

SUMMARY

One or exemplary embodiments include a dispersion-type inorganic field emission device and, more particularly, a dispersion-type inorganic field emission device having substantially improved brightness.

Additional exemplary embodiments will be set forth in part in the description herein.

According to one or more exemplary embodiments, an inorganic field emission device includes: a first electrode and a second electrode spaced apart from the first electrode; a light emitting layer disposed between the first electrode and the second electrode; a dielectric layer disposed in at least one of a space between the first electrode and the light emitting layer, and a space between the second electrode and the light emitting layer; and a field reinforcing layer disposed between the dielectric layer and the light emitting layer. The field reinforcing layer includes carbon nanotubes ("CNTs") having a length of about 20 nanometers (nm) to about 1 micrometer (μm).

More specifically, the length of the CNTs may be about 100 nm to about 800 nm. The CNTs may have a diameter of about 5 to about 10 nm.

The light emitting layer may include an insulating binder and phosphor particles dispersed in the insulating binder.

The first electrode may include a transparent conductive material, and the second electrode may include a transparent conductive material or a metal.

According to one or more alternative exemplary embodiments, an inorganic field emission device includes: a first electrode and a second electrode spaced apart from the first electrode; a light emitting layer disposed between the first electrode and the second electrode; a dielectric layer disposed in at least one of a space between the first electrode and the light emitting layer, and a space between the second electrode and the light emitting layer; and a field reinforcing layer disposed in at least one of a space between the first electrode and the dielectric layer, and a space between the second electrode and the dielectric layer. In an exemplary embodiment, the field reinforcing layer includes CNTs having a length of about 20 nm to about 1 μm.

More particularly, the length of the CNTs may be about 100 nm to about 800 nm. The CNTs may have a diameter of about 5 nm to about 10 nm.

The light emitting layer may include an insulating binder and phosphor particles dispersed in the insulating binder.

The first electrode may include a transparent conductive material, and the second electrode may include a transparent conductive material or a metal.

According to one or more alternative exemplary embodiments, an inorganic field emission device includes: a first electrode an a second electrode spaced apart from the first electrode; a light emitting layer disposed between the first electrode and the second electrode; a dielectric layer disposed between the first electrode and the light emitting layer; and a field reinforcing layer disposed between the second electrode and the light emitting layer. The field reinforcing layer includes CNTs having a length of about 20 nm to about 1 μm.

The length of the CNTs may be about 100 nm to about 800 nm, and the CNTs may have a diameter of about 5 nm to about 10 nm.

The light emitting layer may include an insulating binder and phosphor particles dispersed in the insulating binder.

The first electrode may include a transparent conductive material, and the second electrode may include a transparent material or a metal.

According to one or more alternative exemplary embodiments, an inorganic field emission device includes a first electrode and a second electrode spaced apart from the first electrode, and a field reinforcing light emitting layer disposed between the first electrode and the second electrode. The field reinforcing light emitting layer includes CNTs having a length of about 20 nm to about 1 μm. The inorganic field emission device further includes a dielectric layer disposed in at least one of a space between the first electrode and the field reinforcing light emitting layer, and a space between the second electrode and the field reinforcing light emitting layer.

The field reinforcing light emitting layer may include an insulating binder, the CNTs, and phosphor particles and, the CNTs and the phosphor particles may be dispersed in the insulating binder.

The length of the CNTs may be about 100 nm to about 800 nm.

A diameter of the CNTs may be about 5 nm to about 10 nm.

The first electrode may include a transparent conductive material, and the second electrode may include a transparent conductive material or a metal.

In yet another alternative exemplary embodiment, an inorganic field emission device includes: a first electrode and a second electrode spaced apart from the first electrode; a light emitting layer disposed between the first electrode and the second electrode; a dielectric layer disposed between the first electrode and the light emitting layer; and a field reinforcing layer disposed between the first electrode and the light emitting layer. The field reinforcing layer includes CNTs having a length of about 20 nm to about 1 μm.

In an exemplary embodiment, the length of the carbon nanotubes may be about 100 nm to about 800 nm.

The CNTs may have a diameter of about 5 nm to about 10 nm

The light emitting layer may include an insulating binder and phosphor particles dispersed in the insulating binder.

The first electrode may include a transparent conductive material, and the second electrode may include a transparent material or a metal.

According to one or more exemplary embodiments, a brightness and/or efficiency of an inorganic field emission device are substantially improved by using carbon nanotubes having a short length in a field reinforcing layer.

BRIEF DESCRIPTION OF THE DRAWINGS

The above and/or other aspects, features and advantages will become more readily apparent and more readily appreciated by describing in further detail exemplary embodiments with reference to the accompanying drawings, in which.

DETAILED DESCRIPTION

Figure 1:
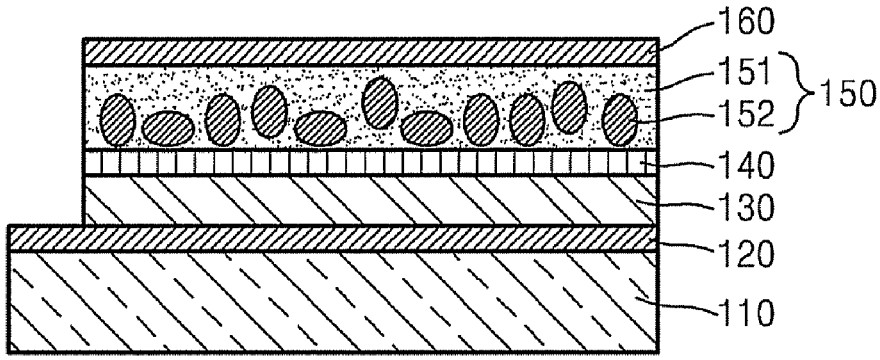
FIG. 1 is a partial cross-sectional view of an exemplary embodiment of a dispersion-type inorganic field emission device.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting. As used herein, the singular forms "a," "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Hereinafter, exemplary embodiments will be described in further detail with reference to the accompanying drawings.

FIG. 1 is a partial cross-sectional view of an exemplary embodiment of an inorganic field emission device and, more particularly, is a partial cross-sectional view of an exemplary embodiment of a dispersion-type inorganic field emission device.

Referring to FIG. 1, a first electrode 120 is disposed on a substrate 110. The substrate 110 may be a transparent substrate, such as a glass substrate or a plastic substrate, for example. The first electrode 120 may be a transparent electrode, and may include, e.g., may be formed of, a transparent conductive material such as indium tin oxide ("ITO"). A dielectric layer 130 is disposed on the first electrode 120. The dielectric layer 130 may be formed by coating a paste including a mixture of a barium titanate ($BaTiO_3$) powder and an organic binder onto the first electrode 120 by using a screen printing method, for example.

A field reinforcing layer 140 is disposed on the dielectric layer 130. The field reinforcing layer 140 substantially improves a brightness and efficiency of the dispersion-type inorganic field emission device according to an exemplary embodiment by reinforcing an electric field generated in a light emitting layer 150, which will be described in greater detail below, and which includes carbon nanotubes ("CNTs"). The field reinforcing layer 140 may include CNTs having a short length. Specifically, for example, the field reinforcing layer 140 may include CNTs having a length of about 20 nanometers (nm) to about 1 micrometer (μm). More specifically, the field reinforcing layer 140 according to an exemplary embodiment may include CNTs having a length of about 100 nm to about 800 nm. In addition, the CNTs included in the field reinforcing layer 140 may have a diameter of several to several tens of nanometers. More particularly, the CNTs included in the field reinforcing layer 140 according to an exemplary embodiment may have a diameter of about 5 nm to about 10 nm.

When CNTs having a length of about 3 μm or more are used in a field reinforcing layer of a field emission device, a percolation path of current is formed in the field emission device, due to a longer length of the CNTs (relative to the lengths of the CNTs according to the exemplary embodiments described herein). Thus, a brightness of the field emission device using CNTs having the longer length is improved, since the percolation path of current is formed. However, an excessive current flows in the field emission device using the CNTs with the longer length. As a result, an efficiency of the field emission device is substantially reduced. Thus, in an exemplary embodiment, CNTs having a relatively short length, such as about 20 nm to about 1 μm, for example, are used in the field reinforcing layer 140. More particularly, CNTs having a length of about 20 nm to about 1 μm may be prepared by cutting the CNTs having the long length, e.g., of 3 μm or more, to a shorter desired length. Thus, when the CNTs having the shorter length are used in the field reinforcing layer 140 according to the exemplary embodiments described herein, a brightness of a field emission device including the field reinforcing layer 140 is substantially improved, while a driving current of the field emission device is substantially reduced, thereby substantially improving an efficiency of the field emission device according an exemplary embodiment.

The field reinforcing layer 140 according to an exemplary embodiment may be formed by mixing CNTs having a short length, and isopropanol, which is an organic solvent, and sodium dodecylbenzene suifonate (NaDDBS), which is a surfactant for improving dispersion of the CNTs, and then coating the mixture onto the dielectric layer 130 by using a spin coating method, for example.

Referring still to FIG. 1, the light emitting layer 150 is disposed on the field reinforcing layer 140. The light emitting layer 150 may include an insulating binder 151 and phosphor particles 152 dispersed in the insulating binder 151. The phosphor particles 152 may be formed of phosphor having a mother body that is an oxide or sulfide doped with emissive ions exhibiting red, green or blue color. In an exemplary embodiment, the light emitting layer 150 is a material layer wherein field emission occurs. In addition, electrons, accelerated by a field applied into the light emitting layer 150, collide with the phosphor particles 152, thereby emitting visible light exhibiting a desired color. The light emitting layer 150 may be formed by coating a paste containing a mixture of the phosphor particles 152 and the insulating binder 151 onto the field reinforcing layer 140 by using a screen printing method, for example.

A second electrode 160 is disposed on the light emitting layer 150, as shown in FIG. 1. The second electrode 160 may be formed of a transparent conductive material such as ITO, or a metal such as silver (Ag).

Thus, in the dispersion-type inorganic field emission device according to an exemplary embodiment, the brightness and efficiency of the dispersion-type inorganic field emission device are substantially improved, by forming the field reinforcing layer 140 to include CNTs, having a short length of about 20 nm to about 1 μm, between the light emitting layer 150 and the dielectric layer 130.

Figure 2:
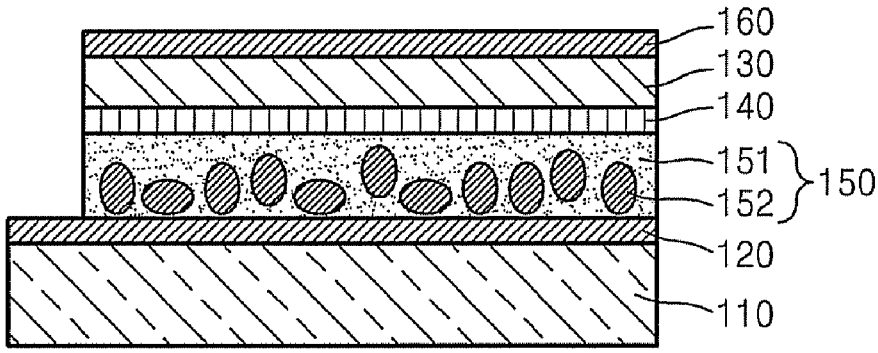
FIG. 2 is a partial cross-sectional view of an alternative exemplary embodiment of a dispersion-type inorganic field emission device.

FIG. 2 is a partial cross-sectional view of an alternative exemplary embodiment of a dispersion-type inorganic field emission. The same or like components in FIGS. 1 and 2 have been labeled with the same reference characters therein, and any repetitive detailed description thereof will hereinafter be omitted or simplified. Referring to FIG. 2, the dielectric layer 130 is disposed between the light emitting layer 150 and the second electrode 160, in which the second electrode 160 is an upper electrode. The field reinforcing layer 140 includes CNTs having a short length of about 20 nm to about 1 μm, and is disposed between the dielectric layer 130 and the light emitting layer 150, as shown in FIG. 2.

In an alternative exemplary embodiment, the dielectric layer 130 may be disposed between the first electrode 120 and the light emitting layer 150, and between the second electrode 160 and the light emitting layer 150. In this case, a lower dielectric layer (not shown) may be disposed between the first electrode 120 and the light emitting layer 150, and an upper dielectric layer (not shown) may be disposed between the second electrode 160 and the light emitting layer 150. The field reinforcing layer 140 including CNTs having the short length may be disposed between the lower dielectric layer and the light emitting layer 150, and between the upper dielectric layer and the light emitting layer 150.

Figure 3:
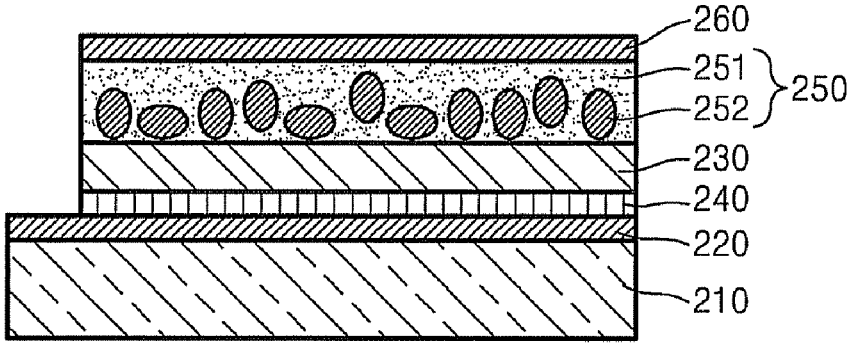
FIG. 3 is a partial cross-sectional view of another alternative exemplary embodiment of an inorganic field emission device.

FIG. 3 is a partial cross-sectional view of another alternative exemplary embodiment of an inorganic field emission device. Hereinafter, the inorganic field emission device according to the exemplary embodiment shown in FIG. 3 will be described in terms of differences from the above-described alternative exemplary embodiments.

Referring to FIG. 3, a first electrode 220 is disposed on a substrate 210. The substrate 210 may be a transparent substrate. The first electrode 220 may be a transparent electrode, and may be formed of a transparent conductive material such as ITO, for example. A field reinforcing layer 240 is disposed on the first electrode 220. The field reinforcing layer 240 may include CNTs having a short length, e.g., of about 20 nm to about 1 μm. More specifically, the field reinforcing layer 240 according to an exemplary embodiment may include CNTs having a length of about 100 nm to about 800 nm. The CNTs included in the field reinforcing layer 240 may have a diameter of several to several tens of nanometers. More specifically, the CNTs included in the field reinforcing layer 240 according to an exemplary embodiment may have a diameter of about 5 nm to about 10 nm.

A dielectric layer 230 is disposed on the field reinforcing layer 240. In addition, a light emitting layer 250 is disposed on the dielectric layer 230. The light emitting layer 250 may include an insulating binder 251 and phosphor particles 252 dispersed in the insulating binder 251. The light emitting layer 250 may be formed by coating a paste containing a mixture of the phosphor particles 252 and the insulating binder 251 onto the dielectric layer 230 by using a screen printing method, for example. A second electrode 260 is disposed on the light emitting layer 250. The second electrode 260 may be formed of a transparent conductive material such as ITO, or a metal such as Ag, for example.

Figure 4:
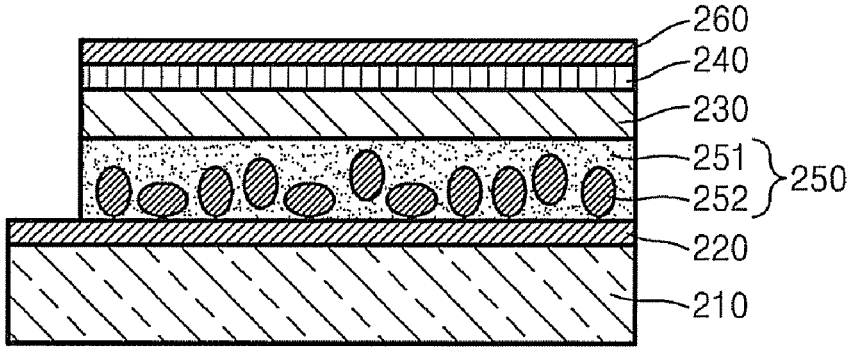
FIG. 4 is a partial cross-sectional view of yet another alternative exemplary embodiment of an inorganic field emission device.

FIG. 4 is a partial cross-sectional view of still another alternative exemplary embodiment of an inorganic field emission device. The same or like components in FIGS. 3 and 4 have been labeled with the same reference characters therein, and any repetitive detailed description thereof will hereinafter be omitted or simplified. Referring to FIG. 4, the dielectric layer 230 is disposed between the light emitting layer 250 and the second electrode 260, wherein the second electrode 260 is an upper electrode. The field reinforcing layer 240, including the CNTs having the short length of about 20 nm to about 1 μm, may be disposed between the dielectric layer 230 and the second electrode 260 that is the upper electrode.

Alternatively, in an exemplary embodiment, the dielectric layer 230 may be disposed between the first electrode 220 and the light emitting layer 250, and between the second electrode 260 and the light emitting layer 250. In this case, a lower dielectric layer (not shown) is disposed between the light emitting layer 250 and the first electrode 220, wherein the first electrode 220 is a lower electrode, and between the light emitting layer 250 and the second electrode 260, wherein the second electrode 260 is an upper electrode. In this case, the field reinforcing layer 240 including the CNTs having a short length may be disposed between the first electrode 220 and the lower dielectric layer, and between the second electrode 260 and the upper dielectric layer.

Figure 5:
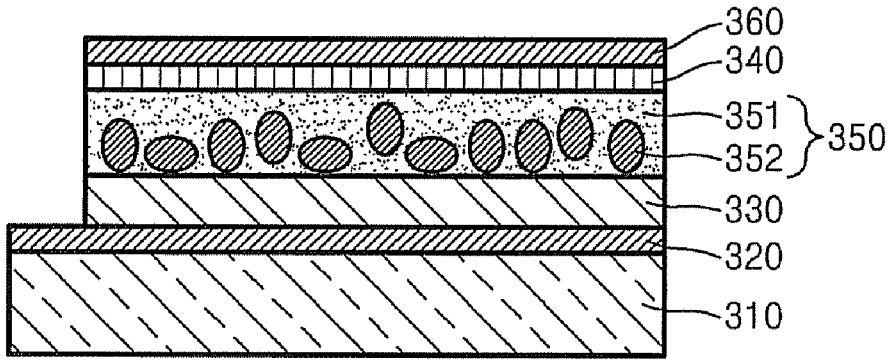
FIG. 5 is a partial cross-sectional view of still another alternative exemplary embodiment of an inorganic field emission.

FIG. 5 is a partial cross-sectional view of still another alternative exemplary embodiment of an inorganic field emission device. Hereinafter, the inorganic field emission device according to the exemplary embodiment shown in FIG. 5 will be described in terms of differences from the above-described alternative exemplary embodiments.

Referring to FIG. 5, a first electrode 320 is disposed on a substrate 310. The substrate 310 may be a transparent substrate. The first electrode 320 may be a transparent electrode, and may be formed of a transparent conductive material such as ITO, for example. A dielectric layer 330 is disposed on the first electrode 320. In addition, a light emitting layer 350 is disposed on the dielectric layer 330. The light emitting layer 350 may include an insulating binder 351 and phosphor particles 352 dispersed in the insulating binder 351.

A field reinforcing layer 340 is disposed on the light emitting layer 350. The field reinforcing layer 340 may include CNTs having a short length of about 20 nm to about 1 μm. More specifically, the field reinforcing layer 340 according to an exemplary embodiment may include CNTs having a length of about 100 nm to about 800 nm. The CNTs included in the reinforcing layer 340 may have a diameter of several to several tens of nanometers. More specifically, the CNTs included in the reinforcing layer 340 according to an exemplary embodiment may have a diameter of about 5 nm to about 10 nm. A second electrode 360 is disposed on the field reinforcing layer 340. The second electrode 360 may be formed of a transparent conductive material such as ITO, or a metal such as Ag, for example.

Figure 6:
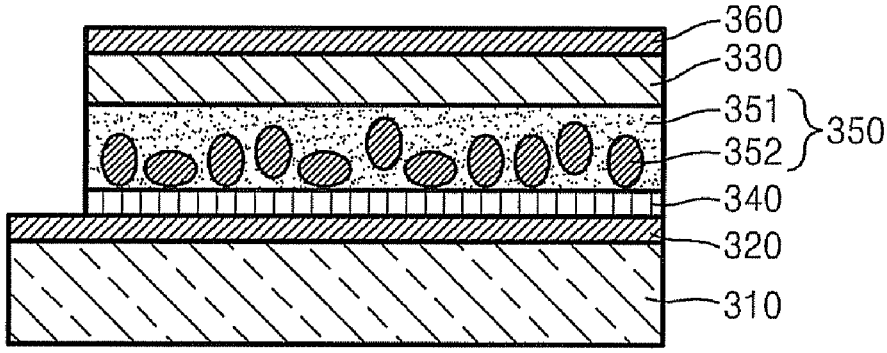
FIG. 6 is a partial cross-sectional view of another alternative exemplary embodiment of an inorganic field emission device.

FIG. 6 is a partial cross-sectional view of yet another alternative exemplary embodiment of an inorganic field emission device. The same or like components in FIGS. 5 and 6 have been labeled with the same reference characters therein, and any repetitive detailed description thereof will hereinafter be omitted or simplified. Referring to FIG. 6, the dielectric layer 330 is disposed between the light emitting layer 350 and the second electrode 360, wherein the second electrode 360 is an upper electrode. The field reinforcing layer 340 including CNTs having the short length of about 20 nm to about 1 μm may be disposed between the first electrode 320, in which the first electrode 320 is a lower electrode, and the light emitting layer 350.

Figure 7:
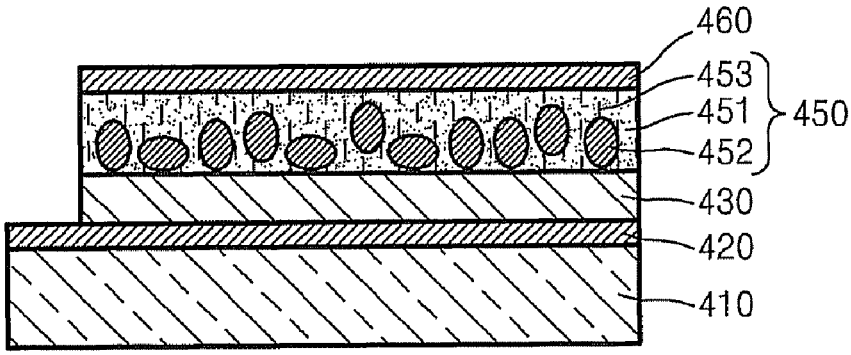
FIG. 7 is a partial cross-sectional view of still another alternative exemplary embodiment of an inorganic field emission device.

FIG. 7 is a partial cross-sectional view of yet another alternative exemplary embodiment of an inorganic field emission device. Hereinafter, the inorganic field emission device according to the exemplary embodiment shown in FIG. 7 will be described in terms of differences from the above-described alternative exemplary embodiments.

Referring to FIG. 7, a first electrode 420 is disposed on a substrate 410. The substrate 410 may be a transparent substrate. The first electrode 420 may be a transparent electrode, and may be formed of a transparent conductive material such as ITO, for example. A dielectric layer 430 is disposed on the first electrode 420. The dielectric layer 430 may be formed by coating a paste containing a mixture of a $BaTiO_3$ powder and an organic binder onto the first electrode 420 by using a screen printing method, but alternative exemplary embodiments are not limited thereto.

A field reinforcing light emitting layer 450 is disposed on the dielectric layer 430. The field reinforcing light emitting layer 450 includes an insulating binder 451, phosphor particles 452 dispersed in the insulating binder 451, and CNTs 453 having a short length, as described in greater detail above. In the field reinforcing light emitting layer 450, an electric field is reinforced by the CNTs 453, and visible rays are generated by the phosphor particles 452. In an exemplary embodiment, the field reinforcing light emitting layer 450 may include the CNTs 453 having a short length of about 20 nm to about 1 μm. More particularly, the field reinforcing light emitting layer 450 according to an exemplary embodiment may include the CNTs 453 having a short length of about 100 nm to about 800 nm. The CNTs 453 may have a diameter of several to several tens of nm. More specifically, the CNTs 453 according to an exemplary embodiment may have a diameter of about 5 nm to about 10 nm.

The phosphor particles 452 may be formed of phosphor having a mother body that is an oxide or sulfide doped with emissive ions exhibiting red, green or blue color. The field reinforcing light emitting layer 450 may be formed by coating a paste containing a mixture of the CNTs 453 having the short length, the phosphor particles 452, and the insulating binder 451 onto the dielectric layer 430 by using a screen printing method, for example. A second electrode 460 is disposed on the field reinforcing light emitting layer 450. The second electrode 460 may be formed of a transparent conductive material such as ITO, or a metal such as Ag, but alternative exemplary embodiments are not limited thereto.

Thus, in an inorganic field emission device according to an exemplary embodiment a brightness and efficiency of the inorganic field emission device are substantially improved, by dispersing the CNTs 453 having the short length and the phosphor particles 452 in the insulating binder 451, and forming the field reinforcing light emitting layer 450 both reinforcing an electric field and emitting visible rays.

Figure 8:
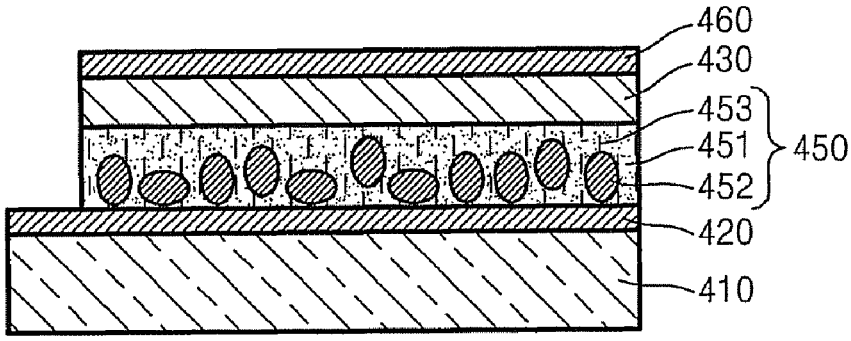
FIG. 8 is a partial cross-sectional view of yet another alternative exemplary embodiment of an inorganic field emission device.

FIG. 8 is a partial cross-sectional view of still another alternative exemplary embodiment of an inorganic field emission device. The same or like components in FIGS. 7 and 8 have been labeled with the same reference characters therein, and any repetitive detailed description thereof will hereinafter be omitted or simplified. Referring to FIG. 8, the dielectric layer 430 is disposed on a lower surface of the second electrode 460, in which the second electrode 460 is an upper electrode, and the field reinforcing light emitting layer 450 is disposed between the dielectric layer 430 and the first electrode 420, in which the first electrode 420 is a lower electrode. The field reinforcing light emitting layer 450 includes the insulating binder 451, the CNTs 453 having the short length of about 20 nm to about 1 μm, and the phosphor particles 452, wherein the CNTs 453 and the phosphor particles 452 are dispersed in the insulating binder 451.

As described herein, according to one or more exemplary embodiment, by forming a field reinforcing layer or, alternatively, a field reinforcing light emitting layer, using CNTs having a short length, e.g., of about 20 nm to about 1 μm, a brightness of an inorganic field emission device is substantially improved, and a driving current thereof is substantially decreased, thereby substantially improving an efficiency of the inorganic field emission device according to the one or more exemplary embodiments described herein.

It will understood that the exemplary embodiments described herein are to be considered in a descriptive sense only, and not for purposes of limitation. Descriptions of features or aspects within each exemplary embodiment should typically be considered as available for other similar features or aspects in other embodiments.

In addition, while the exemplary embodiments have been particularly shown and described herein, it will be understood by those of ordinary skill in the art that various changes in form and details may be made therein without departing from the spirit or scope of the present invention as defined by the following claims.

What is claimed is:

1. An inorganic field emission device comprising:

a first electrode and a second electrode spaced apart from the first electrode;

a light emitting layer disposed between the first electrode and the second electrode;

a dielectric layer disposed in at least one of a space between the first electrode and the light emitting layer, and a space between the second electrode and the light emitting layer; and a field reinforcing layer disposed between the dielectric layer and the light emitting layer, wherein the field reinforcing layer comprises carbon nanotubes having a length of about 20 nanometers to about 1 micrometer.

2. The inorganic field emission device of claim 1, wherein the length of the carbon nanotubes is about 100 nanometers to about 800 nanometers.

3. The inorganic field emission device of claim 1, wherein the carbon nanotubes have a diameter of about 5 nanometers to about 10 nanometers.

4. The inorganic field emission device of claim 1, wherein the light emitting layer comprises:

an insulating binder; and phosphor particles dispersed in the insulating binder.

5. The inorganic field emission device of claim 1, wherein the first electrode comprises a transparent conductive material, and the second electrode comprises one of a transparent conductive material and a metal.

6. An inorganic field emission device comprising:

a first electrode and a second electrode spaced apart from the first electrode;

a light emitting layer disposed between the first electrode and the second electrode;

a dielectric layer disposed in at least one of a space between the first electrode and the light emitting layer, and a space between the second electrode and the light emitting layer; and a field reinforcing layer disposed in at least one of a space between the first electrode and the dielectric layer, and a space between the second electrode and the dielectric layer, wherein the field reinforcing layer comprises carbon nanotubes having a length of about 20 nanometers to about 1 micrometer.

7. The inorganic field emission device of claim 6, wherein the length of the carbon nanotubes is about 100 nanometers to about 800 nanometers.

8. The inorganic field emission device of claim 6, wherein the carbon nanotubes have a diameter of about 5 nanometers to about 10 nanometers.

9. The inorganic field emission device of claim 6, wherein the light emitting layer comprises:

an insulating binder; and phosphor particles dispersed in the insulating binder.

10. The inorganic field emission device of claim 6, wherein the first electrode comprises a transparent conductive material, and the second electrode comprises one of a transparent conductive material and a metal.

11. An inorganic field emission device comprising:

a first electrode and a second electrode spaced apart from the first electrode;

a light emitting layer disposed between the first electrode and the second electrode;

a dielectric layer disposed between the first electrode and the light emitting layer; and a field reinforcing layer disposed between the second electrode and the light emitting layer, wherein the field reinforcing layer comprises carbon nanotubes having a length of about 20 nanometers to about 1 micrometer.

12. The inorganic field emission device of claim 11, wherein the length of the carbon nanotubes is about 100 nanometers to about 800 nanometers.

13. The inorganic field emission device of claim 11, wherein the carbon nanotubes have a diameter of about 5 nanometers to about 10 nanometers.

14. The inorganic field emission device of claim 11, wherein the light emitting layer comprises:

an insulating binder; and phosphor particles dispersed in the insulating binder.

15. The inorganic field emission device of claim 11, wherein the first electrode comprises a transparent conductive material, and the second electrode comprises one of a transparent material and a metal.

16. An inorganic field emission device comprising:

a first electrode and a second electrode spaced apart from the first electrode;

a field reinforcing light emitting layer disposed between the first electrode and the second electrode, and comprising carbon nanotubes having a length of about 20 nanometers to about 1 micrometer; and a dielectric layer disposed in at least one of a space between the first electrode and the field reinforcing light emitting layer, and a space between the second electrode and the field reinforcing light emitting layer.

17. The inorganic field emission device of claim 16, wherein the field reinforcing light emitting layer comprises an insulating binder, the carbon nanotubes, and phosphor particles, and the carbon nanotubes and the phosphor particles are dispersed in the insulating binder.

18. The inorganic field emission device of claim 16, wherein the length of the carbon nanotubes is about 100 nanometers to about 800 nanometers.

19. The inorganic field emission device of claim 16, wherein the carbon nanotubes have a diameter of about 5 nanometers to about 10 nanometers.

20. The inorganic field emission device of claim 16, wherein the first electrode comprises a transparent conductive material, and the second electrode comprises one of a transparent conductive material and a metal.

* * * * *